US006305126B1

(12) United States Patent
Hendrickson et al.

(10) Patent No.: US 6,305,126 B1
(45) Date of Patent: Oct. 23, 2001

(54) WINDOW JAMB COMPONENT ASSEMBLY

(75) Inventors: Leslie B. Hendrickson, Roseau; Lenny Wong, Warroad, both of MN (US)

(73) Assignee: Marvin Lumber and Cedar Company, Warroad, MN (US)

( * ) Notice: Subject to any disclaimer, the term of this patent is extended or adjusted under 35 U.S.C. 154(b) by 0 days.

(21) Appl. No.: 09/459,141

(22) Filed: Dec. 10, 1999

(51) Int. Cl.[7] ..... E05D 15/16

(52) U.S. Cl. ..... 49/456; 49/428; 49/434; 49/415; 49/454

(58) Field of Search ..... 49/428, 431, 432, 49/475.1, 414, 434, 415, 416, 454, 455, 456, 457, 435, 436, 437, 423; 52/204.5

(56) References Cited

U.S. PATENT DOCUMENTS

| | | | | |
|---|---|---|---|---|
| 926,735 | * | 7/1909 | Gould | 49/434 |
| 1,038,160 | * | 9/1912 | Leonard | 49/457 |
| 2,593,239 | * | 4/1952 | Anderson | 49/434 |
| 2,595,419 | * | 5/1952 | Smith | 49/423 |
| 2,843,233 | * | 7/1958 | Walsh | 49/431 |
| 2,912,077 | * | 11/1959 | Walsh | 49/431 |
| 3,145,433 | * | 8/1964 | Jones | 49/414 |
| 3,676,956 | * | 7/1972 | Taylor et al. | 49/446 |
| 4,583,639 | * | 4/1986 | Fedick et al. | 206/325 |
| 4,726,148 | * | 2/1988 | Tix | 49/453 |
| 5,414,962 | * | 5/1995 | Forbis et al. | 49/454 |
| 5,566,507 | * | 10/1996 | Schmidt et al. | 49/428 |
| 5,934,031 | * | 8/1999 | DeNormand | 52/204.5 |
| 6,122,864 | * | 9/2000 | Martin | 49/428 |

FOREIGN PATENT DOCUMENTS

| | | | | |
|---|---|---|---|---|
| 220004 | * | 5/1958 | (AU) | 49/431 |
| 605391 | * | 9/1960 | (CA) | 49/431 |

* cited by examiner

*Primary Examiner*—Gregory J. Strimbu
(74) *Attorney, Agent, or Firm*—Schwegman, Lundberg, Woessner & Kluth, P.A.

(57) ABSTRACT

A window jamb component assembly mountable in a jamb of a double hung window for cooperative engagement with the sash assemblies thereof. The component assembly includes a longitudinally elongated jamb liner having upper and lower segments and includes a pair of channel guides spaced apart by a profiled web. The profiled web defines sequentially aligned recesses, namely an inner weather stripping recess, a jamb filler recess and an outer weather stripping recess. A jamb filler, held by the jamb filler recess, provides a uniformly clad surface to match the appearance of the trim of the double hung window by covering one of the weather stripping recesses of each segment. Frame weather stripping for sealingly engaging the sash assemblies of the double hung window is deployed and held in the inner and outer weather stripping recesses not covered by the jamb filler. Such assembly provides a visually pleasing finish, while providing improved cooperation between the window jamb and the sash assemblies.

20 Claims, 5 Drawing Sheets

WINDOW JAMB COMPONENT ASSEMBLY

RELATED APPLICATIONS

This patent application is related to pending patent applications entitled: WINDOW SASH POSITION MAINTAINER, Ser. No. 09/328,085, filed Jun. 8, 1999, now U.S. Pat. No. 6,141,913; and ACTUATOR FOR WINDOW SASH RETENTION MECHANISM, Ser. No. 09/450,648, filed Nov. 23, 1999, each of which is assigned to a common assignee. The related applications are incorporated herein by reference in their entirety.

TECHNICAL FIELD

The present invention relates to windows and carrying systems for jambs of a double hung window, and more particularly to an aesthetically pleasing window jamb component assembly mountable in the jambs of a double hung window for cooperative engagement with the sash assemblies thereof.

BACKGROUND OF INVENTION

Jamb liners having numerous configurations are known for sealed mounting to a window jamb of a double hung window system. A preoccupation of the prior art appears to be the cooperative engagement of the jamb liner with the window jamb. Known liner configurations seek an abuttingly snug and air tight fit for the liner while nonetheless urging elements of the liner outward from the window jamb so as to maintain a substantial degree of functionality and provide, to some degree, an acceptable overall appearance.

Typically, spring or spring hinge members are carried by the rear of a jamb liner for abutting against the window jamb to urge the remainder of the liner outward, thereby providing a secure "fit" for the liner in the jamb. Unfortunately, little attention has been focused upon the exterior configuration, general functionality, and overall appearance of the jamb liner.

The ultimate issue confronting the purchasers of windows is an assessment of quality as a function of cost. Quality issues are typically embodied in the notions of aesthetics and functionality. Aesthetics, even more so than function, can be determinative. Purchasers, whether they be builders or home owners, are drawn to attractive window units, particularly those having a neat or clean appearance.

Of all window system components, jamb liners have emphasized function, namely providing an interface between the window jamb and sash assemblies, at the expense of aesthetics. In the totality of a window system, jamb liners tend to stand out. Ideally, the window jambs should blend into their surroundings while nonetheless maintaining their function within the window system environment.

As such it is most desirable to provide an aesthetically pleasing window jamb finish for a double hung window that retains the aforementioned functional objectives. More particularly, it is most advantageous to provide an attractive window jamb component assembly mountable in the jambs of a double hung window which offers improved sash assembly cooperation.

SUMMARY OF THE INVENTION

The present invention is a window jamb component assembly mountable in the jambs of a double hung window for cooperative engagement with the sash assemblies thereof. The component assembly includes a longitudinally elongated jamb liner having upper and lower segments, and sash assembly carriages spaced apart by a profiled web. The profiled web defines sequentially aligned recesses, namely an inner weather stripping recess, a jamb filler recess, and an outer weather stripping recess.

The window jamb component assembly also includes a jamb filler, held by the jamb filler recess. The jamb filler provides a uniformly clad and visually appealing surface for the jambs of a double hung window.

Frame weather stripping for sealingly engaging the sash assemblies of a double hung window is also provided. The weather stripping is deployed and held in the inner and outer weather stripping recesses. More particularly, an upper weather stripping segment is carried by the upper outer weather stripping recess, while a lower weather stripping segment is carried by the lower inner weather stripping recess.

A rail seal is further included, being positioned to bridge the lower end of the upper weather stripping segment and the upper end of the lower weather stripping segment. By this structure and arrangement, a barrier against undesirable fluid flow is formed throughout the elongation of the longitudinally elongated jamb liner when the sash assemblies of a double hung window are fully closed.

The sash assemblies preferably comprise a pair of longitudinally elongated channel guides. One of the channel guides is an inner elongated channel guide whereas the other is an outer elongated channel guide. The inner elongated channel is adjacent the inner weather stripping recess. The longitudinally elongated channel guides retain balance tubes in their upper segment for guiding the sash assemblies.

The window jamb component assembly of the present invention thereby provides a visually pleasing finish for the window jambs, while providing improved cooperation between the window jamb and the sash assemblies.

More specific features and advantages will become apparent with reference to the DETAILED DESCRIPTION OF THE INVENTION, appended claims, and the accompanying drawing figures.

DETAILED DESCRIPTION OF THE INVENTION

Figure 1:
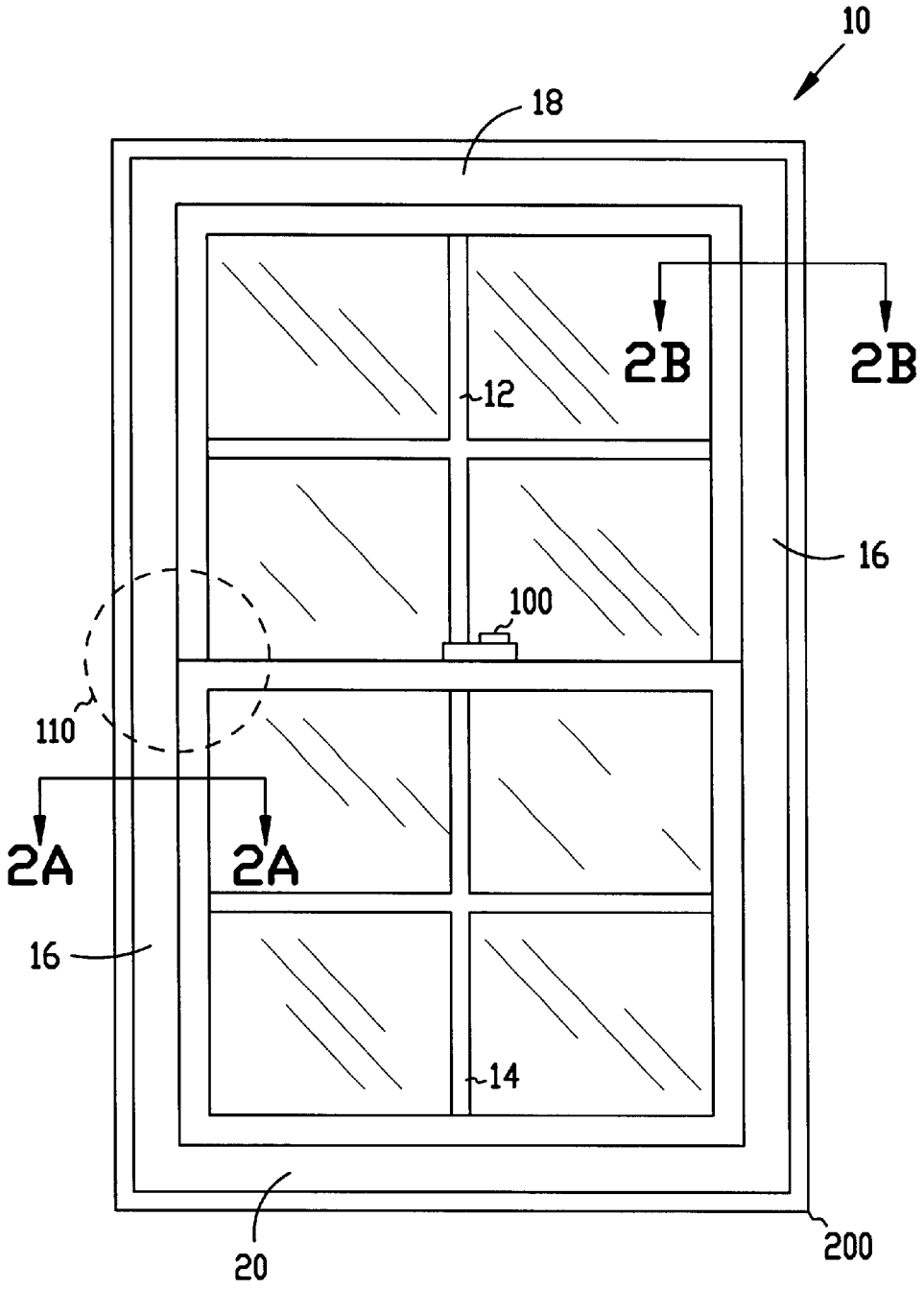
FIG. 1 is an elevational view of a double hung window system.

A double hung window system 10 is generally shown in FIG. 1. Upper 12 (i.e., exterior) and lower 14 (i.e., interior) sashes are supported by opposing side jambs 16, a header jamb 18 and a sill 20 opposite the header jamb 18. The lower (i.e., interior) sash 14 is supported for sliding vertical movement along the side jambs 16.

Figures 2A, 2B:
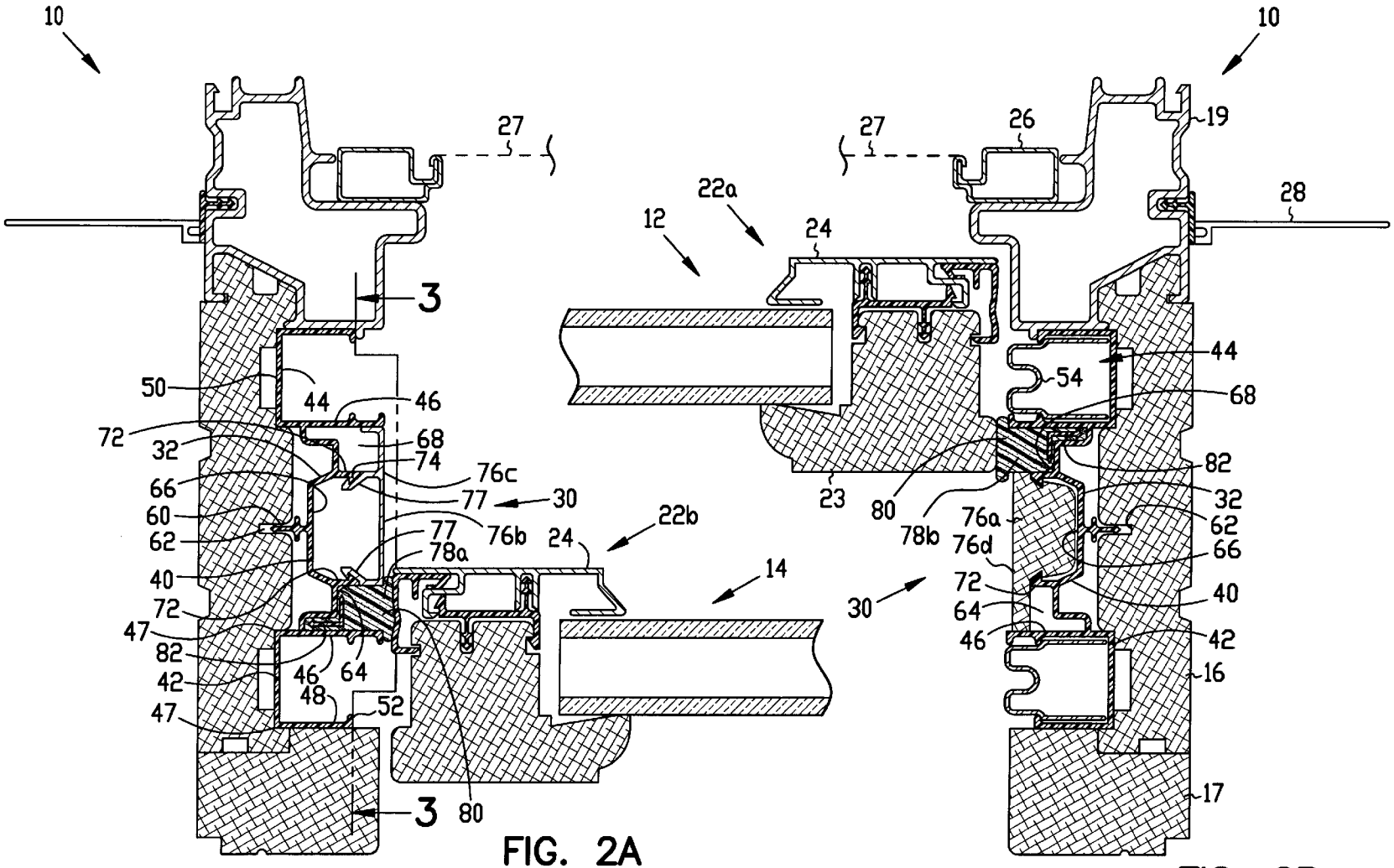
FIGS. 2A and 2B are sectional views taken along lines 2A—2A and 2B—2B of FIG. 1 illustrating lower and upper portions of the window jamb component assembly respectively of the present invention in relation to the various double hung window system assemblies and components.

Referring now to FIGS. 2A and 2B, sectional views of the double hung window are provided illustrating the window jamb component assembly 30 of the present invention and its relationship to the various window system components and assemblies.

Opposing contoured side jambs 16 (i.e., window frames), indirectly, vis-a-vis the window jamb component assemblies 30, support the sash assemblies 22*a* and 22*b*, which typically include stiles 23 and stile cladding 24 which cooperatively support an upper 12 or lower 14 sash. The side jambs 16 of the double hung window system 10 are equipped with interior and exterior finish elements, namely jamb finish liner 17 and jamb cladding 19 respectively, which are shown here in orthogonal abutment with the window jamb component assemblies 30. The jamb cladding 19 carries a screen frame 26, which supports a bug screen 27, and jamb nailing fins 28 which facilitate installation.

Figure 3:
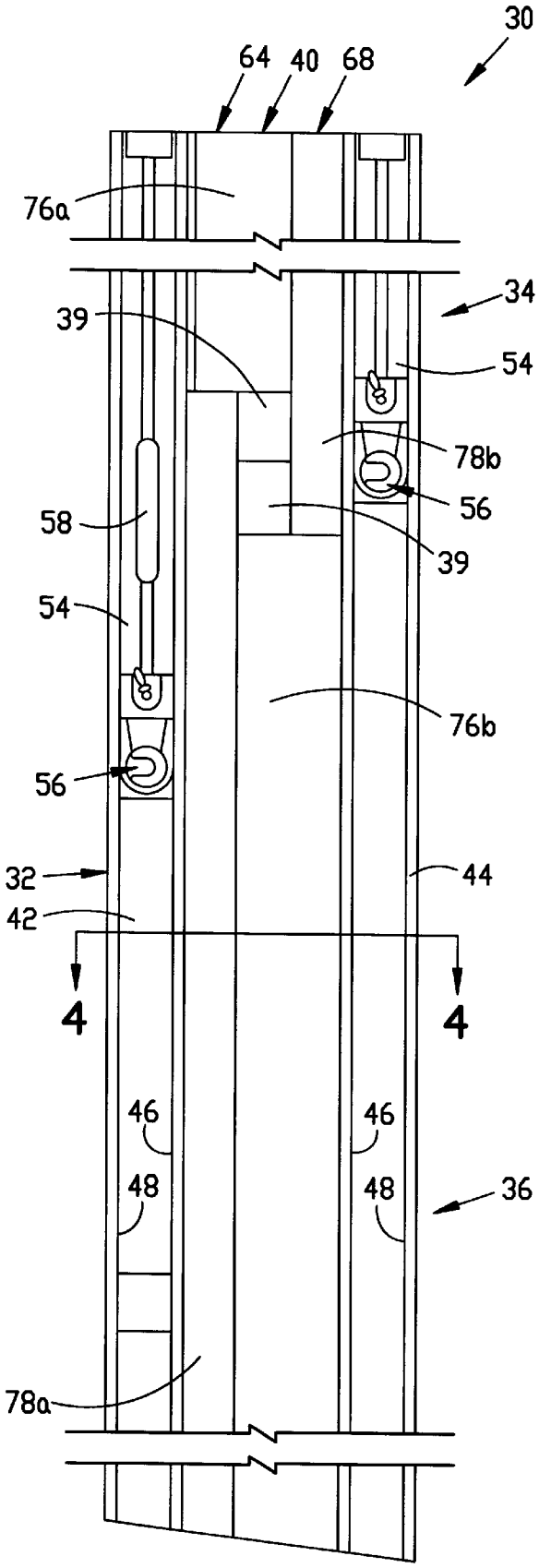
FIG. 3 is a fragmented front elevational view of the window jamb component assembly, particularly illustrating the lower segment thereof.
Figure 4:
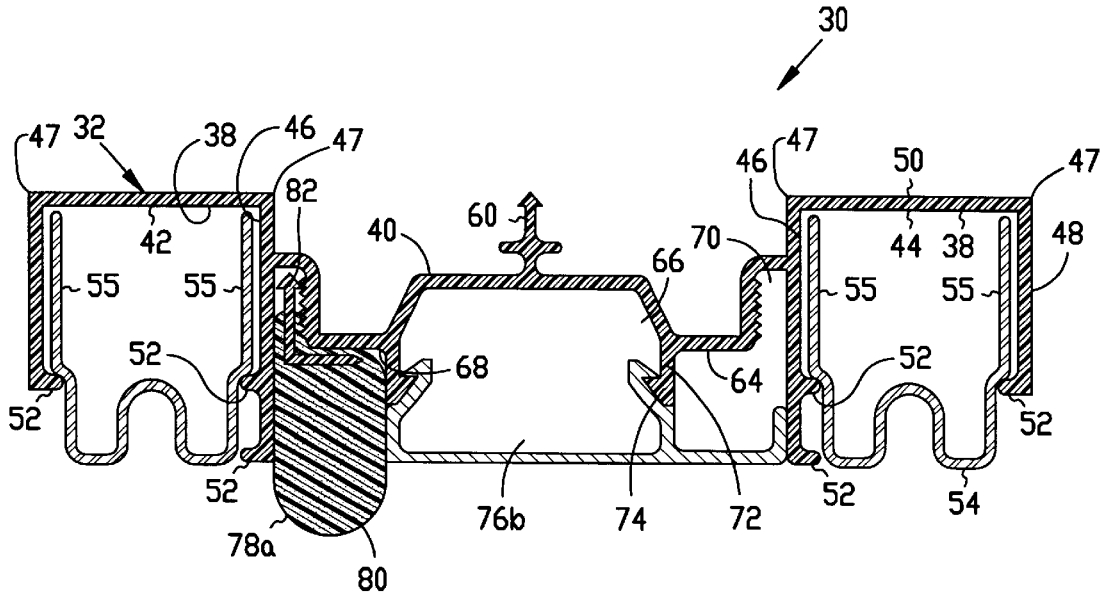
FIG. 4 is a sectional view taken along 4—4 of FIG. 3 illustrating the upper segment components of the window jamb component assembly.

Referring now also to FIGS. 3 and 4, the window jamb component assembly 30 includes a longitudinally elongated jamb liner 32 having upper 34 and lower 36 segments or portions, and sash assembly carriages 38 spaced apart by a transverse profiled web 40. The upper 34 and lower 36 sections are generally or approximately delimited by a check rail seal 39, also shown in FIG. 5.

The sash assembly carriages 38 preferably comprise a pair of longitudinally elongated channel guides, namely an inner (i.e., interior) channel guide 42 and an outer (i.e., exterior) channel guide 44. Each of the channel guides is generally U-shaped, having opposing wall sections, namely inner 46 and outer 48 wall sections, and a rear wall section 50 extending between and joined to the longitudinal rear edges 47 of the inner 46 and outer 48 wall sections to thereby define the channel guide 42, 44. Tabs 52 (i.e., channel tabs) preferably project orthogonally from each of the opposing wall sections 46 and 48 (e.g., the outer wall tab projects in a direction toward the inner wall section), with each opposing wall section 46, 48 of the channel guides 42, 44 terminating in a tab 52 at their free edge.

The upper segments 34 of both the interior 42 and exterior 44 elongated channel guides 42, 44 (i.e., the portion of the channel guides occupying the upper segment 34 of the jamb liner 32) are equipped with balance tubes 54 for guiding the sash assemblies 22*a*, 22*b* (compare the lower 36 and upper 34 segments of the jamb liner 32, left and right sides respectively, in FIGS. 2*a*, 2*b*). The opposingly paired channel tabs 52 cooperatively engage the sidewalls 55 of the stylized W-shaped balance tubes 54, as shown in FIG. 4, to hold them in place. The lower segments 36 of the channel guides 42, 44 carry sash assembly interfacing hardware 56 which facilitates retention and translation of the sash assemblies 22*a*, 22*b* relative to the window jambs 16. Hardware suitable to perform this translation function is known to those skilled in the art.

Although the interior 42 and exterior 44 channel guides are equipped with similar elements, namely balance tubes 54 and sash assembly interfacing hardware 56, they are not identical. The balance tube 54 held by the interior channel guide 42 is longer than its counterpart in the exterior channel guide 44 as illustrated in FIG. 3. Furthermore, to accommodate tilting of the interior sash assembly, the "extended" balance tube 54 held by the interior channel guide 42 includes an interior sash assembly blade extension slot 58. Many styles and arrangements are known for the aforementioned slot and hardware components, including even alternate structures to accomplish window tilting, with those illustrated not intended to be limiting.

The elongated channel guides 42, 44 are joined by the transverse profiled web 40. The web 40 extends from the inner wall section 46 of the interior channel guide 42 to the inner wall section 46 of the exterior channel guide 44 and is preferably in a spaced condition forward from the rear walls 50 of the channel guides 42, 44. A jamb anchor 60 of suitable configuration extends rearwardly from the profiled web 40 for receipt by a side jamb anchor receiver 62 so to securably and directly mount the jamb liner 32, and the window jamb component assembly 30 thereby, to the side jamb 16 (FIGS. 2A and 2B).

The profiled web 40 defines three sequentially aligned component carrying recesses 64, 66, 68: an inner weather stripping recess 64 adjacent the interior elongated channel guide 42; a jamb filler recess 66; and, an outer weather stripping recess 68 adjacent the exterior elongated channel guide 44. As the weather stripping recesses 64, 66, 68 are adjacent the elongated channel guides 42, 44, respectively, they are separated, and in part defined by a substantial portion of the inner wall sections 46 of the opposing walls 46 and 48 of the channel guides 42, 44. These inner wall sections 46, in combination with the profile of the profiled web 48 immediately adjacent the inner wall sections 46, form an elongated groove 70 for receiving a protruding anchor 82 integral to a frame weather stripping member 78*a*, 78*b*, best shown in FIGS. 2A and 2B. Forwardly extending spaced web flanges 72 separate the jamb filler recess 66 from the frame weather stripping recesses 68 and 64. These web flanges 72 include contoured tabs 74 at their free ends for engaging and retaining jamb filler 76.

Referring again to FIGS. 2A and 2B, the window jamb component assemblies 30, both the upper 34 and lower 36 segments, respectively, are shown in cross section. The lower segment 36 of the component assembly 30 is shown on the left, cooperating with the interior sash assembly 22*b* whereas the upper segment 34 of the component assembly 30 is shown on the right, cooperating with the exterior sash assembly 22*a*.

The lower segment 36 of the longitudinally elongated jamb liner 32 carries a jamb cover 76*b* in the jamb filler recess 66 and a weather stripping member 78*a* in the inner weather stripping recess 64. The unoccupied outer weather stripping recess 68 of the profiled web 40 is hidden or disguised by the jamb cover 76*b* which provides a uniformly clad surface for the window jambs 16. In this lower jamb liner segment 36, the jamb cover 76*b* is configured to form a substantially uniformly clad surface 76*c* which transversely extends from the inner weather stripping member 78*a* to the inner wall section 46 of the outer channel guide 44. Cover flanges 77, configured to cooperatively engage with the web flanges 72, extend from the underside of the jamb cover 76*b*.

The jamb cover 76*b* is intended to match in appearance the exterior trim of the double hung window 10. Typically, an aluminum construction is desirable, although not so limited. The critical consideration is that a neat, clean, high quality, low maintenance finish is provided consistent with the exterior finish of the window 10.

The upper segment 34 of the longitudinally elongated jamb liner 32 carries a jamb filler 76*a* in the jamb filler recess 66 and a weather stripping member 78*b* in the outer weather stripping recess 68. The unoccupied inner weather stripping recess 64 of the profiled web 40 is hidden or disguised, as in the lower segment, by the jamb filler 76*a* which provides a uniform wood or planar exterior finish surface 76*d* for the window jambs 16. In this upper jamb liner segment 34, the jamb filler 76*a* is preferably configured to substantially conform to the jamb filler recess 66 and cooperate with the web flanges 72 of the profiled web 40. The upper jamb filler 76*a* has a substantially planar exterior finish surface 76*d* which transversely extends from the outer weather stripping member 78*b* to the inner wall section 46 of the inner channel guide 42.

The upper jamb filler 76*a* is intended to match in appearance the interior trim of the double hung window 10. Typically, a wood construction is desirable, although not so limited. The critical consideration is that a neat, clean, high quality, low maintenance finish is provided, consistent with the interior finish of the window 10.

The jamb liner 32 of the window jamb component assembly 30 is generally constructed of an extruded plastic material, for example polyvinyl chloride or other thermoplastic elastomer, that is at preferably semi-rigid. The jamb liner 32 materials are not particularly critical, and other fabrications known to those skilled in the art are likewise suitable, tending to be application specific.

In addition to the enhanced aesthetics provided by the jamb component assembly 30, improved sliding and sealing of the sash assemblies 22*a*, 22*b* is realized with the aforementioned jamb component assembly 30 weather stripping configuration.

During translation of either of the sash assemblies 22*a*, 22*b*, the assemblies 22*a*, 22*b* move off of their weather strip seal (FIG. 2), with the friction therebetween greatly reduced throughout the range of translation (e.g., as interior sash assembly 22*b* moves in an upward direction, from the lower 36 to upper 34 segment of the jamb liner 32, the frictional force attributable to the weather stripping is attenuated). Extending the inner weather stripping member 78*a* in the inner weather stripping recess 64 upward to an elevation substantially coterminous with the upper extent of the check rail seal 39 while at the same time extending the outer weather stripping member 78*b* in the outer weather stripping recess 68 downward to an elevation coterminous with the lower extent of the check rail seal 39 (FIG. 3) insures formation of a barrier against undesirable fluid flow throughout the elongation of the jamb liner 32 when the sash assemblies 22*a*, 22*b* are fully closed. The key here is that there be some degree of communication between the upper and lower weather stripping members via the check rail seal 39 as shown, or by alternate means.

The frame weather stripping members 78*a* and 78*b* for sealingly engaging the sash assemblies 22*a*, 22*b* preferably includes an elongated foam element 80 (e.g., urethane) carried by an anchor structure 82 (FIG. 4). The base of the weather stripping 64, 68 is generally configured for conformity with the frame weather stripping recess as shown. Alternate arrangements for frame weather stripping members 78*a*, 78*b*, known to those skilled in the art, are likewise contemplated for use in the jamb component assembly 30 of this invention.

Figure 5:
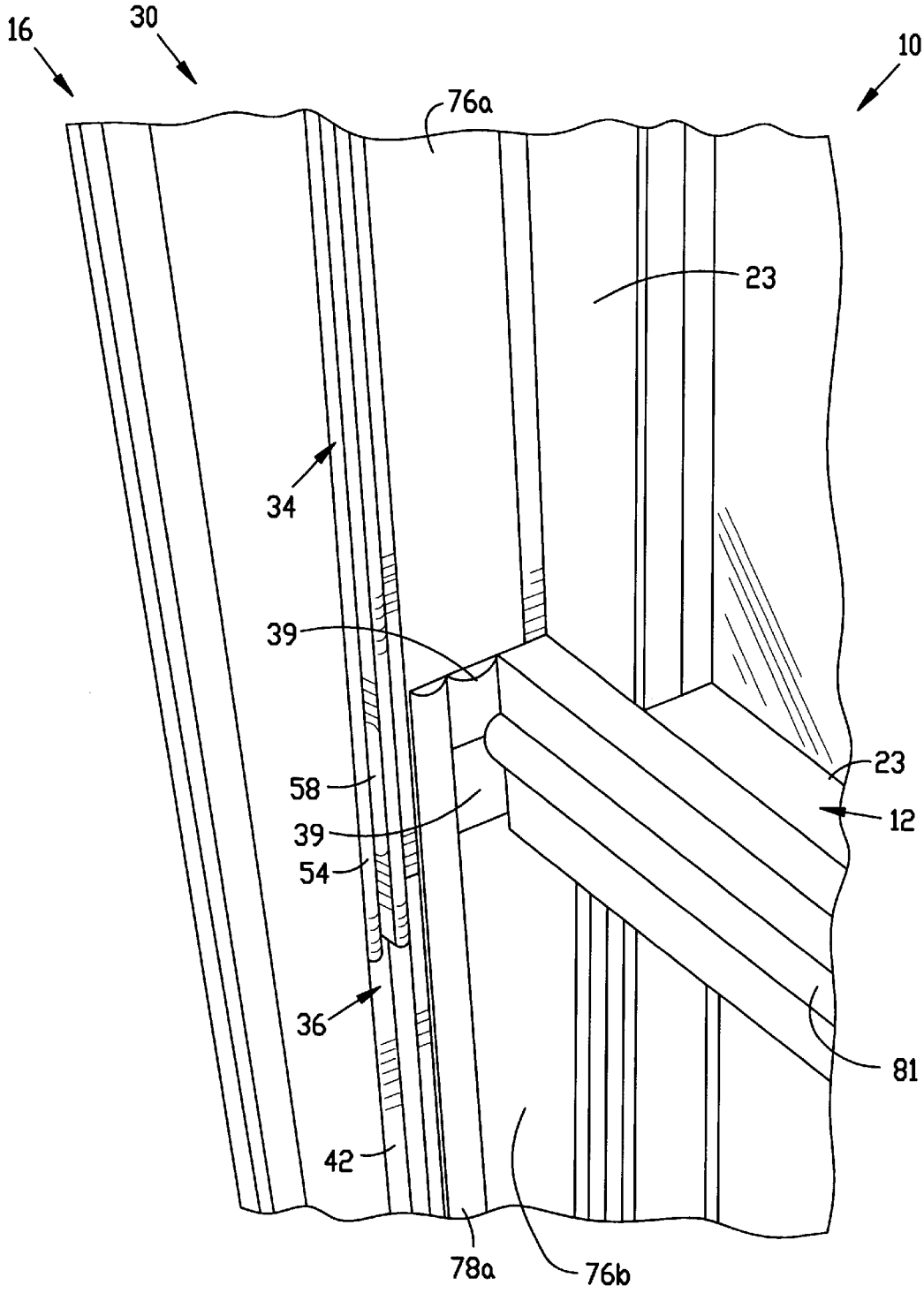
FIG. 5 is a fragmented perspective view of a window jamb equipped with the window jamb component assembly, with the inner sash assembly removed.

Referring finally to FIG. 5, a fragmented perspective view of a window jamb 16 equipped with the window jamb component assembly 36 is shown, with the inner sash assembly 22*b* removed. Here the stile cladding 24 of the interior sash assembly 22*b* abuts the check rail seal 39, which as discussed above, links the upper (i.e., outer) 78*b* and lower (i.e., inner) 78*a* weather stripping members. As such, when the sash assemblies 22*a*, 22*b*, are fully closed, all horizontal weather seals 81, check rail seal 39 and weather stripping members 78*a*, 78*b* are in communication with the vertical weather seals 78*a*, 78*b* to prevent undesirable fluid flow.

It should be noted that the window jamb component assembly 30, the window sash position maintainer (which was incorporated herein by reference), and the sash retention member actuator (which was incorporated herein by reference) can be used alone or in combination with one another, and is considered within the scope of the invention. For instance, a window structure 200, similar to that shown in FIG. 1, could include the window jamb component assembly 30 and the sash retention member actuator 100, where the balance tube 54 described above corresponds with the balance tube shown and discussed in the patent application entitled SASH RETENTION MECHANISM ACTUATOR. Alternatively, a window structure 200 could include the window jamb component assembly 30 and/or the sash retention member actuator 100, and/or the window sash position maintainer, disposed generally at 110, where the window sash position maintainer is discussed further in copending application entitled WINDOW SASH POSITION MAINTAINER, having Ser. No. 09/328,085.

It will be understood that this disclosure, in many respects, is only illustrative. Changes may be made in details, particularly in matters of shape, size, material, and arrangement of parts without exceeding the scope of the invention. Accordingly, the scope of the invention is as defined in the language of the appended claims and their equivalents.

What is claimed is:

1. A window jamb component assembly mountable in a jamb of a double hung window for cooperative engagement with sash assemblies thereof, comprising:

a longitudinally elongated jamb liner having upper and lower segments and sash assembly carriages spaced apart by a profiled web, said profiled web defining sequentially aligned recesses, said sequentially aligned recesses comprising an inner weather stripping recess, a jamb element recess and an outer weather stripping recess;

a jamb element retained by said jamb element recess and covering one of said weather stripping recesses of one of said segments; and frame weather stripping being deployed in the other one of said weather stripping recesses of said segments.

2. The window jamb component assembly of claim 1 wherein said sash assembly carriages comprise a pair of longitudinally elongated channel guides, one of said longitudinally elongated channel guides being an inner elongated channel guide, the other of said longitudinally elongated channel guides being an outer elongated channel guide, said inner weather stripping recess being adjacent said inner elongated channel guide.

3. The window jamb component assembly of claim 2 further comprising balance tubes for guiding the sash assemblies of the double hung window, said balance tubes being substantially retained in the channel guides.

4. The window jamb component assembly of claim 1 further comprising frame weather stripping being deployed in said one of said weather stripping recesses of the other one of said segments.

5. The window jamb component assembly of claim 4 further comprising a rail seal interposed between adjacent end portions of the frame weather strippings.

6. The window jamb component assembly of claim 1 wherein said jamb element forms a substantially rigid facing which is substantially flush with the sash assembly carriages.

7. The window jamb component assembly of claim 1 wherein the jamb element is adapted to be substantially flush with an exterior trim of the double hung window.

8. The window jamb component assembly of claim 7 wherein the jamb element is constructed of aluminum.

9. The window jamb component assembly of claim 1 wherein the jamb element is adapted to be substantially flush with an interior trim of the double hung window.

10. The window jamb component assembly of claim 9 wherein the jamb element is constructed of wood.

11. The window jamb component assembly of claim 1 wherein each of said inner and outer weather stripping recesses includes an elongated channel for receiving an anchor stricture of said frame weather stripping.

12. The window jamb component assembly of claim 1 wherein said profiled web further includes a jamb anchor for securably mounting said component assembly to the jamb of the double hung window, said jamb anchor projecting outwardly from said profiled web in a direction opposite a direction said sequentially aligned recesses face.

13. A longitudinally elongated jamb liner comprising upper and lower segments; a pair of longitudinally elongated channel guides spaced apart by a profiled web, one of said elongated channel guides being an inner elongated channel guide, the other of said elongated channel guides being an outer elongated channel guide, said profiled web including sequentially aligned recesses, said sequentially aligned recesses being an inner weather stripping recess, a jamb element recess and an outer weather stripping recess, said inner weather stripping recess being adjacent said inner elongated channel guide; and a jamb element, said jamb element being retained by said jamb element recess of one of said segments and covering only one of said weather stripping recesses of said one of said segments.

14. A longitudinally elongated jamb liner comprising:

upper and lower segments;

a first elongated channel, a second elongated channel, a third elongated channel, a fourth elongated channel, and a fifth elongated channel, the elongated channels being sequentially spaced apart and parallel therewith; and a jamb element adapted to provide a uniformly clad surface for a jamb, the third elongated channel of only one of said segments retaining the jamb element with the jamb element covering only one of the second and fourth elongated channels of said only one of said segments.

15. The longitudinally elongated jamb liner of claim 14, further comprising a second jamb element adapted to provide a uniformly clad surface for the jamb, the third elongated channel of only the other one of said segments retaining the second jamb element with the second jamb element covering the other of one of the second and fourth elongated channels of the other one of said segments.

16. The longitudinally elongated jamb liner of claim 15 further comprising weather stripping seals deployed in the second and fourth elongated channels not covered by the jamb elements.

17. The longitudinally elongated jamb liner of claim 15 wherein one of said jamb elements is adapted to be substantially flush with an exterior trim of a double hung window.

18. The longitudinally elongated jamb liner of claim 17 wherein the other one of said jamb elements is adapted to be substantially flush with an interior trim of the double hung window.

19. The longitudinally elongated jamb liner of claim 15 wherein said first and fifth elongated channels comprise sash assembly carriages, and wherein one of said jamb elements forms a substantially rigid facing which is substantially flush with one of the sash assembly carriages.

20. The longitudinally elongated jamb liner of claim 19 further comprising balance tubes for guiding sash assemblies of a double hung window, each of said balance tubes being substantially retained within a respective one of the sash assembly carriages.

* * * * *

UNITED STATES PATENT AND TRADEMARK OFFICE

CERTIFICATE OF CORRECTION

PATENT NO. : 6,305,126 B1 
DATED : October 23, 2001
INVENTOR(S) : Leslie B. Hendrickson and Lenny Wong It is certified that error appears in the above-identified patent and that said Letters Patent is hereby corrected as shown below:

Title page,
Item [75], Inventors, delete "Roseau;" and insert -- Warroad; --, therefor.

Column 3,
Line 35, delete "guide" after "channel" and insert -- guides --, therefor.
Line 52, delete "42, 44" and insert -- 46, 48 --, therefor.

Column 4,
Line 25, delete "48" after "web" and insert -- 40 --, therefor.

Column 5,
Line 61, delete "36" after "assembly" and insert -- 30 --, therefor.

Signed and Sealed this

Sixth Day of August, 2002

*Attest:*

*Attesting Officer*

JAMES E. ROGAN
*Director of the United States Patent and Trademark Office*